United States Patent [19]

Takauji

[11] Patent Number: 4,955,278

[45] Date of Patent: Sep. 11, 1990

[54] OPTIMIZATION OF WAVEFORM OPERATION IN ELECTRONIC MUSICAL INSTRUMENT

[75] Inventor: Kiyomi Takauji, Shizuoka, Japan

[73] Assignee: Kabushiki Kaisha Kawai Gakii Seisakusho, Japan

[21] Appl. No.: 311,235

[22] Filed: Feb. 15, 1989

Related U.S. Application Data

[63] Continuation of Ser. No. 92,220, Sep. 2, 1987, abandoned.

[30] Foreign Application Priority Data

Sep. 19, 1986 [JP] Japan ..... 61-221647

[51] Int. Cl.[5] ..... G10H 1/18; G10H 7/04

[52] U.S. Cl. ..... 84/605; 84/617; 84/655; 341/26; 341/27

[58] Field of Search ..... 84/1.01, 1.19, 1.28, 84/DIG. 2, DIG. 23, 605, 615–620, 653–658; 341/22, 26, 27

[56] References Cited

U.S. PATENT DOCUMENTS

| | | | |
|---|---|---|---|
| Re. 32,069 | 1/1986 | Tomisawa | 340/365 S X |
| 3,899,951 | 8/1975 | Griffith et al. | 84/1.01 |
| 4,134,320 | 1/1979 | Oya | 340/365 S X |
| 4,193,038 | 3/1980 | Kashio | 84/1.01 X |
| 4,218,948 | 8/1980 | Nakada et al. | 84/1.01 |
| 4,387,617 | 6/1983 | Kato et al. | 340/365 S X |
| 4,408,511 | 10/1983 | Deforeit | 340/365 S X |
| 4,570,520 | 2/1986 | Deutsch et al. | 84/1.01 |
| 4,653,375 | 3/1987 | Honda et al. | 84/1.01 |
| 4,805,509 | 2/1989 | Matsuda | 84/1.01 |

*Primary Examiner*—Stanley J. Witkowski

*Attorney, Agent, or Firm*—McGlew & Tuttle

[57] ABSTRACT

An electronic musical instrument having a number of keys, having tone generators capable of simultaneous tone production, the tone generators being smaller in number than the number of keys. The instrument forms an operation for synthesizing a desired waveform, the operation for synthesizing a desired waveform being performed in a repeating cyclic order with an operation cycle and in which the waveform is transferred to the tone generators and read out therefrom at a rate in accordance with the note of a key being depressed to obtain a desired musical waveform. The device includes a number-of-depressed keys detecting device which counts the number of keys which are actuating the tone generator upon depression. A cycle altering device is provided for changing the operation cycle, as a whole, on the basis of the number of depressed keys, counted by the number-of-depressed keys detecting device. The construction allows for a waveform of a smooth temporal variation to be produced.

5 Claims, 6 Drawing Sheets

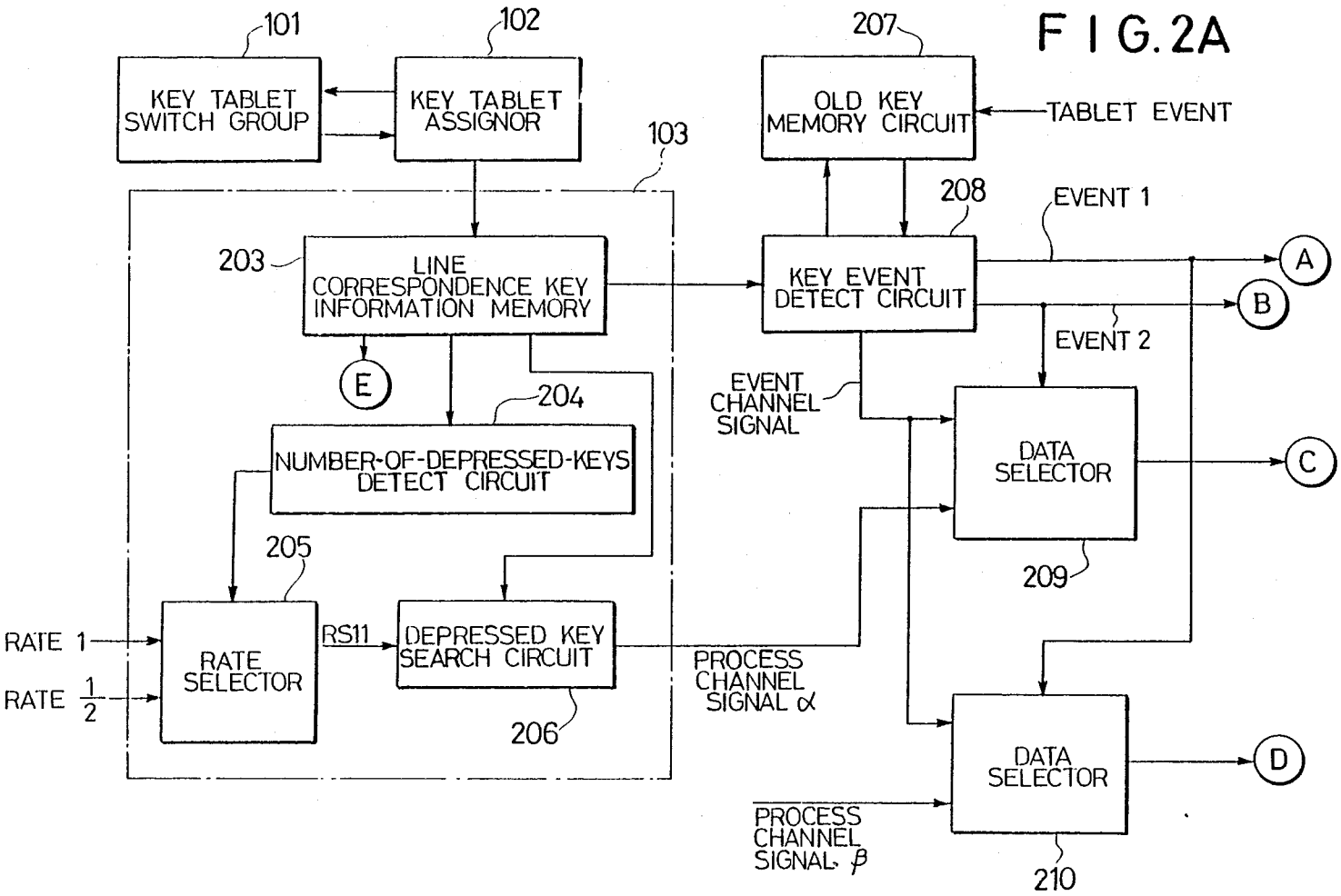
FIG. 2A
TABLET EVENT
EVENT 1
EVENT 2
A
B
C
D
E
OLD KEY MEMORY CIRCUIT
207
KEY EVENT DETECT CIRCUIT
208
DATA SELECTOR
209
DATA SELECTOR
210
EVENT CHANNEL SIGNAL
PROCESS CHANNEL SIGNAL α
PROCESS CHANNEL SIGNAL β
103
KEY TABLET ASSIGNOR
102
KEY TABLET SWITCH GROUP
101
LINE CORRESPONDENCE KEY INFORMATION MEMORY
203
NUMBER-OF-DEPRESSED-KEYS DETECT CIRCUIT
204
DEPRESSED KEY SEARCH CIRCUIT
206
RS11
RATE SELECTOR
205
RATE 1
RATE 1/2

OPTIMIZATION OF WAVEFORM OPERATION IN ELECTRONIC MUSICAL INSTRUMENT

This is a file wrapper continuation of application Ser. No. 092220 filed Sept. 2, 1987, which is now abandoned.

BACKGROUND OF THE INVENTION

1. Field of the Invention

The present invention relates to an electronic musical instrument in which the operation cycle for obtaining a musical waveform through utilization of Fourier function synthesizing techniques is changed in accordance with the number of keys being depressed simultaneously, thereby eliminating the discontinuity in temporal variation of the resulting musical tone.

2. Description of the Prior Art

Heretofore there has been a demand for an electronic musical instrument which has a number of tone production lines, each including many tone production channels, to lend realism to each tone. To meet this demand, it is necessary to employ tone production channels, in each of which a musical waveform varies smoothly with time, creating a tone rich in realism. In such tone production channels, however, operations must be performed on a time-shared basis at all times, for which time slots for operation must be secured regardless of actual key depression and release. This will introduce discontinuity in the temporal variation of the musical waveform, causing a reduction in realism of the resulting musical tone and leading to the generation of noise.

FIGS. 4A and 4B are a diagram explanatory of a prior art example, in which a musical tone generating system 100 creates a desired musical tone by use of ordinary Fourier synthesis techniques.

A key tablet assignor 102 scans a key tablet switch group 101 to detect the ON/OFF state, touch response, or similar information of key switches included in the group 101 and holds the information of the respective switches. The information is provided to a control circuit 103 which controls the system 100.

When supplied with the information from the key tablet assignor 102, the control circuit 103 sets a composite waveform in a main memory 108 on the basis of the following Fourier synthesis equation (1):

$$Zn = \sum_{q=1}^{W} Cq \cdot \sin \frac{2\pi nq}{2W}, \text{ where } n = 1 \text{ to } 2W. \quad (1)$$

In the above, q is the harmonic order, n the sample point number, W the number of harmonics, Cq a temporally varying harmonic coefficient, and Zn a sample value. The procedure for the above operation is as follows: A harmonic coefficient generator 105 responds to a control signal from the control circuit 103 to produce the harmonic coefficient Cq of a desired timbre. The harmonic coefficient Cq thus obtained and a q-order sine wave value, $$\sin \frac{\pi nq}{W},$$

which is read out of a sine wave function table 104 by a signal from the control circuit 103, are multiplied in a multiplier 106. The multiplied value from the multiplier 106 is accumulated by an accumulator 107, by which the composite waveform expressed by Eq. (1) is created and stored in the main memory 108.

Next, the composite waveform thus stored in the main memory 108 is transferred therefrom via a transfer select circuit 109 to at least one of note memories 110-l to 110-m (which can be formed by a single memory through use of time-sharing techniques) corresponding to keys in lines A, B and C. The waveform data thus stored is read out of the corresponding note memories in the respective lines, without exerting any influence upon the composite waveform, by note frequency data from a note frequency data generator 111 which generates note frequency data corresponding to a key being depressed. The waveform data read out from each of the note memories 110-l to 110-m, corresponding to a note scale, is multiplied in one of multipliers 112-l to 112-m, by an envelope output waveform from an envelope generator 113 which generates the envelope waveform corresponding to the depressed key, thus producing musical waveform data added with an envelope. The musical waveform data from the multipliers 112-l to 112 m is converted by D/A converters 114-l to 114-m into an analog waveform, which is applied to a sound system 115, creating a desired musical tone.

The reason for which the lines A, B and C are shown is to indicate that a number of lines are needed in an electronic musical instrument. That is, a number of tone production channels are required in the case of creating different musical tones of several kinds of lines in response to the depression of a single key or in the case of automatic playing of the electronic musical instrument. Now, let it be assumed that the lines A and B each create a musical tone which varies with time (i.e. a musical tone whose harmonic component varies with time) and that the line C creates a musical tone which does not vary with time and whose waveform varies only when a key is newly depressed or when timbre needs to be changed. In such a system it is necessary to always perform waveform operations for the respective note memories of the lines A and B in a repeating cyclic order and write therein the operation results. In this instance, however, when the numbers of note memories in the lines A and B are large, one cycle of operations for all the note memories of the respective lines will take much time. In other words, operations for the note memories of the lines A and B are each performed at long time intervals, with the result that the musical waveform does not smoothely vary with time. When each line includes m note memories as mentioned above, the overall time for operating one musical waveform is 2mT, where T is the time for the waveform operation per note memory.

Where a large number of keys are depressed at the same time, human hearing cannot differentiate individual tones since they are masked by one another, but in the case where a small number of keys are depressed concurrently, individual tones can easily be differentiated from one another. Accordingly, when the number of keys depressed simultaneously during waveform operations at regular intervals is reduced abruptly, there will be created a feeling of discontinuity in the temporal variation of the resulting musical waveform. To avoid this, the present invention changes the operation cycle with the number of depressed keys so that the waveform operation for the depressed keys is quickly performed and immediately followed by the next waveform operation. It is expected that the smoothness of the waveform variation will be improved by switching the above-mentioned operation cycle 2mt to $\frac{1}{2}$, $\theta$, $\frac{1}{8}$, . . . in accordance with the number of keys being depressed.

SUMMARY OF THE INVENTION

It is therefore an obJect of the present invention to provide an electronic musical instrument in which the number of keys being depressed is counted and the operation cycle for the musical waveform is changed accordingly.

To attain the above obJect, the electronic musical instrument of the present invention, which has tone generators capable of simultaneous tone production and smaller in number than the number of keys provided and operates a desired musical waveform through the Fourier function synthesis system, comprises detect means for counting the number of keys which actuate the tone generators by their depression, and means for changing the entire operation cycle in accordance with the number of depressed keys counted by the detect means.

According to the present invention, letting the operation cycle in the case of a certain large number of keys being depressed be represented by 2mT, when the number of concurrently depressed keys is reduced by half, the operation cycle is changed to 2mT/2 and when the number of depressed keys is reduced to $\frac{1}{4}$, the operation cycle is switched to 2mT/4. In this way, the operation cycle is changed with the number of keys being depressed, by which when the number of depressed keys is reduced, the temporal variation of the musical waveform is rendered smooth, alleviating a feeling of discontinuity in the variation of the resulting musical tones.

BRIEF DESCRIPTION OF THE DRAWINGS

FIGS. 2A and 2B are a block diagram illustrating the arrangement of an embodiment of the present invention.

DESCRIPTION OF THE PREFERRED EMBODIMENTS

Figures 1A, 1B, 1C:
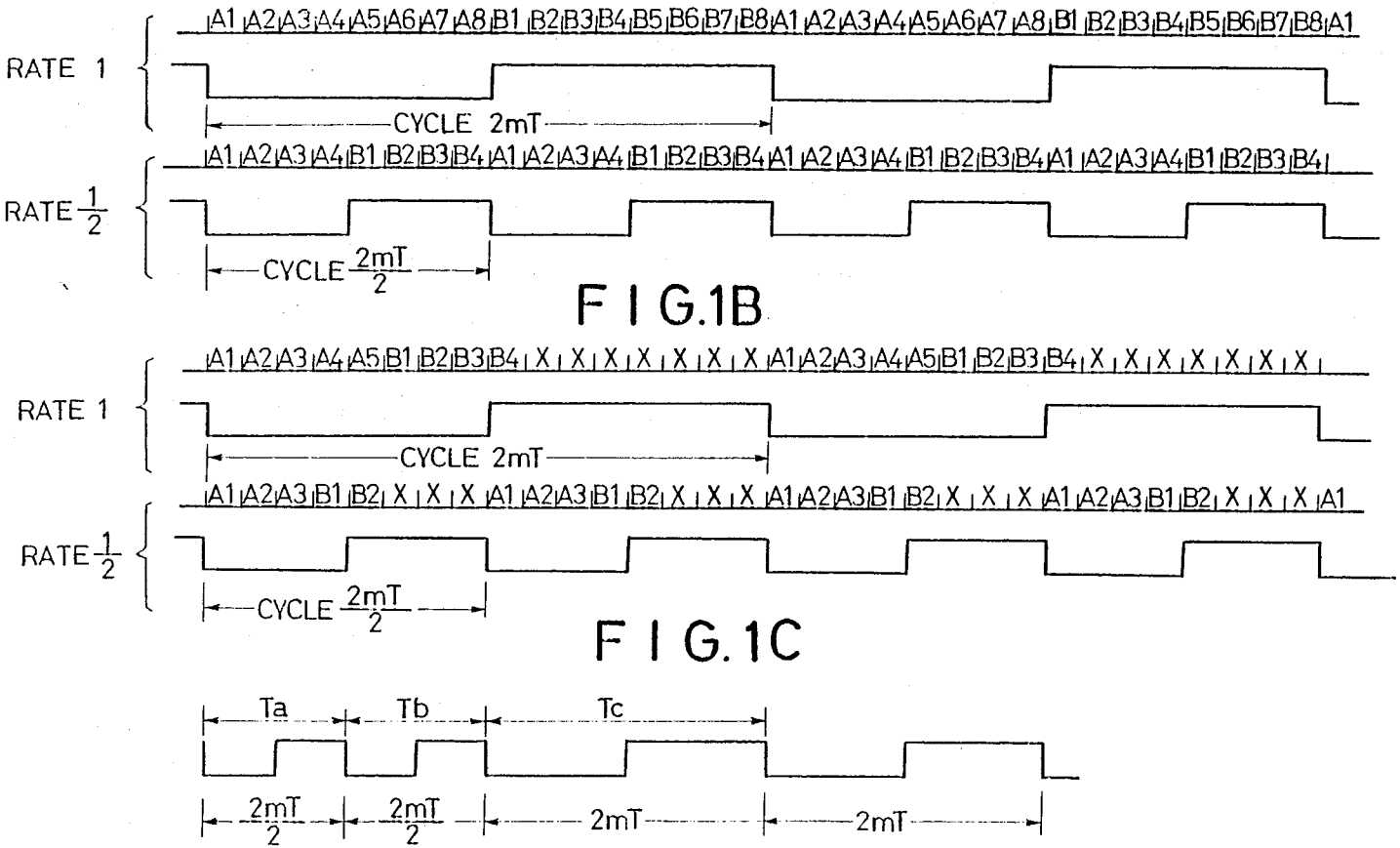
FIGS. 1A through 1C are diagrams for explaining the principle of the present invention.

FIGS. 1A through 1C are a diagram explanatory of the principle of the present invention, showing that the waveform operation cycle differs with the number of keys being depressed. The lines A and B are both shown to include eight note memories. Reference characters A1 to A8 and B1 to B8 are sequence numbers of the note memories of the lines A and B. FIG. 1A shows an example in which the waveform operation cycle is switched between rates 1 and $\frac{1}{2}$ in accordance with the number of keys being depressed. The rate 1 is used when the depression of keys involves actuation of all the note memories in the lines A and B, and the waveform operation cycle in this instance is 2mT, i.e. 16T (since m=8). On the other hand, the rate $\frac{1}{2}$ is used when the depression of keys involves actuation of first to fourth note memories in the lines A and B, and the waveform operation cycle in this case is 2mT/2 , i.e. 8T. That is to say, two kinds of waveform operation cycles are selectively used depending upon whether the number of keys depressed (the number of note memories actuated) is smaller than nine or greater than eight. Thus the waveform operation cycle is reduced when the number of keys being depressed is small. Both in the cases of the rates 1 and $\frac{1}{2}$ shown in FIG. 1A, keys are depressed in all time slots within the operation cycle. FIG. 1B shows timing charts in the case where nine keys are depressed and accordingly nine note memories are actuated in the lines A and B, that is, in the case of the rate 1 for the depression of 9 to 16 keys, and in the case where five keys are depressed and accordingly five note memories are actuated in the lines A and B, that is, in the case of the rate $\frac{1}{2}$ for the depression of 1 to 8 keys. In this instance, time slots in which no key depression takes place become pseudo-operation slots. FIG. 1C shows that the waveform operation time Tb is determined by the number of depressed keys (the number of note memories actuated in the lines A and B) detected in the waveform operation time Ta and that when the number of depressed keys detected again in the waveform operation time Tb is larger than the number which can be processed within the time 2mT/2, the next waveform operation time Tc becomes twice longer than the preceding waveform operation time Tb. While in the above the waveform operation cycle is described to be set to only 1 and $\frac{1}{2}$, it may also be set to $\frac{1}{4}$, $\frac{1}{8}$, etc.

Figure 2B:
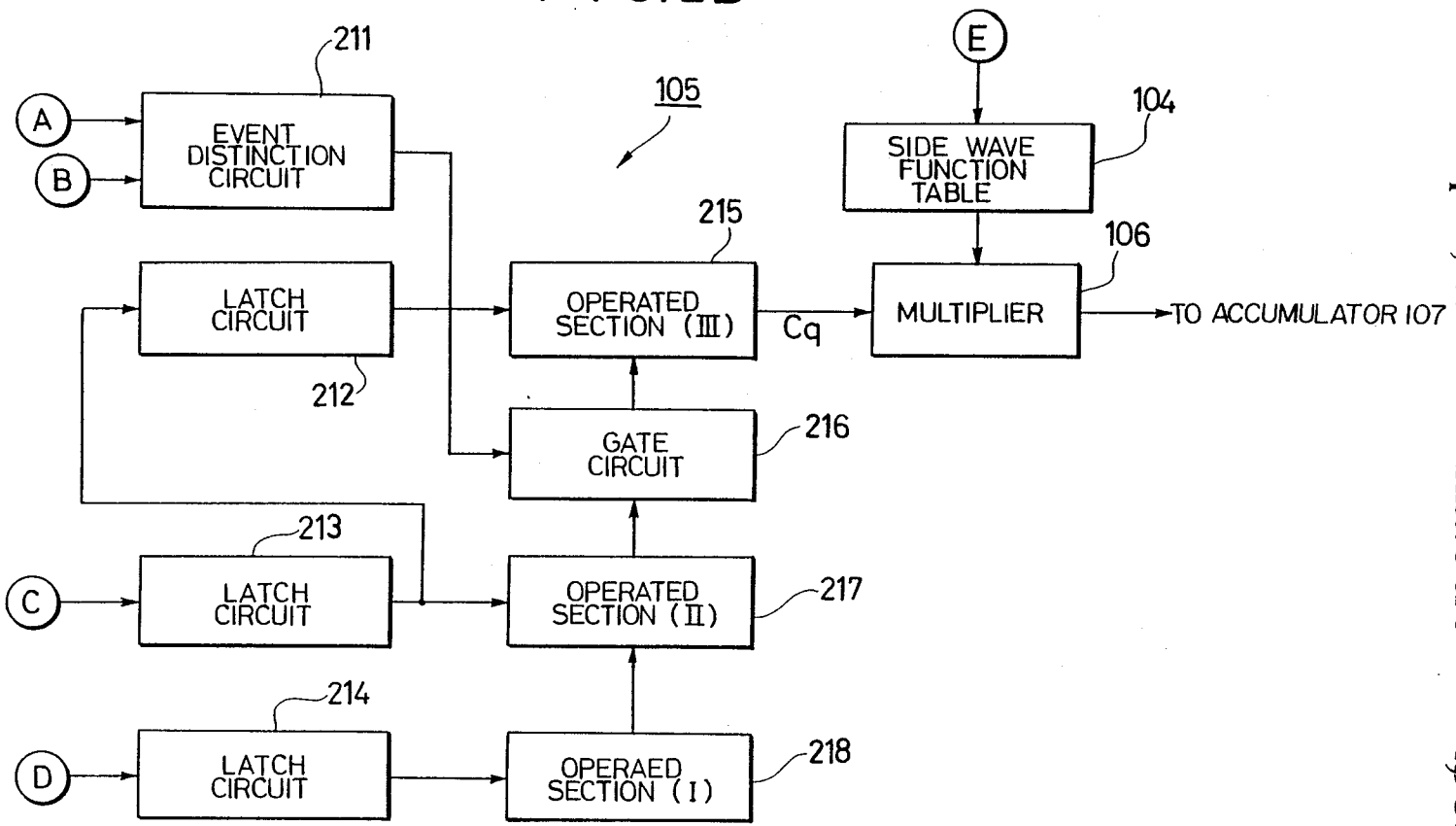
Figure 4A:
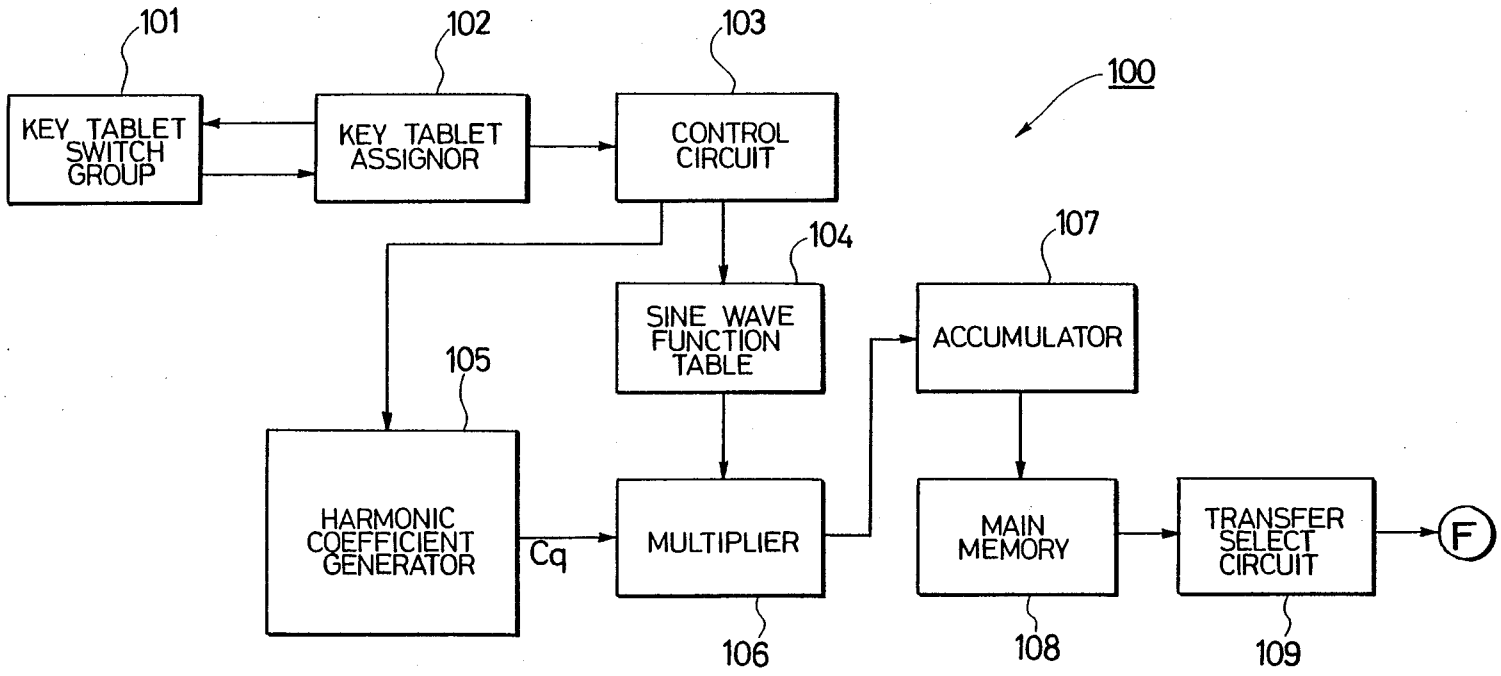
FIG.4A (PRIOR ART)
FIGS. 4A and 4B are a block diagram illustrating a prior art example.
Figure 4B:
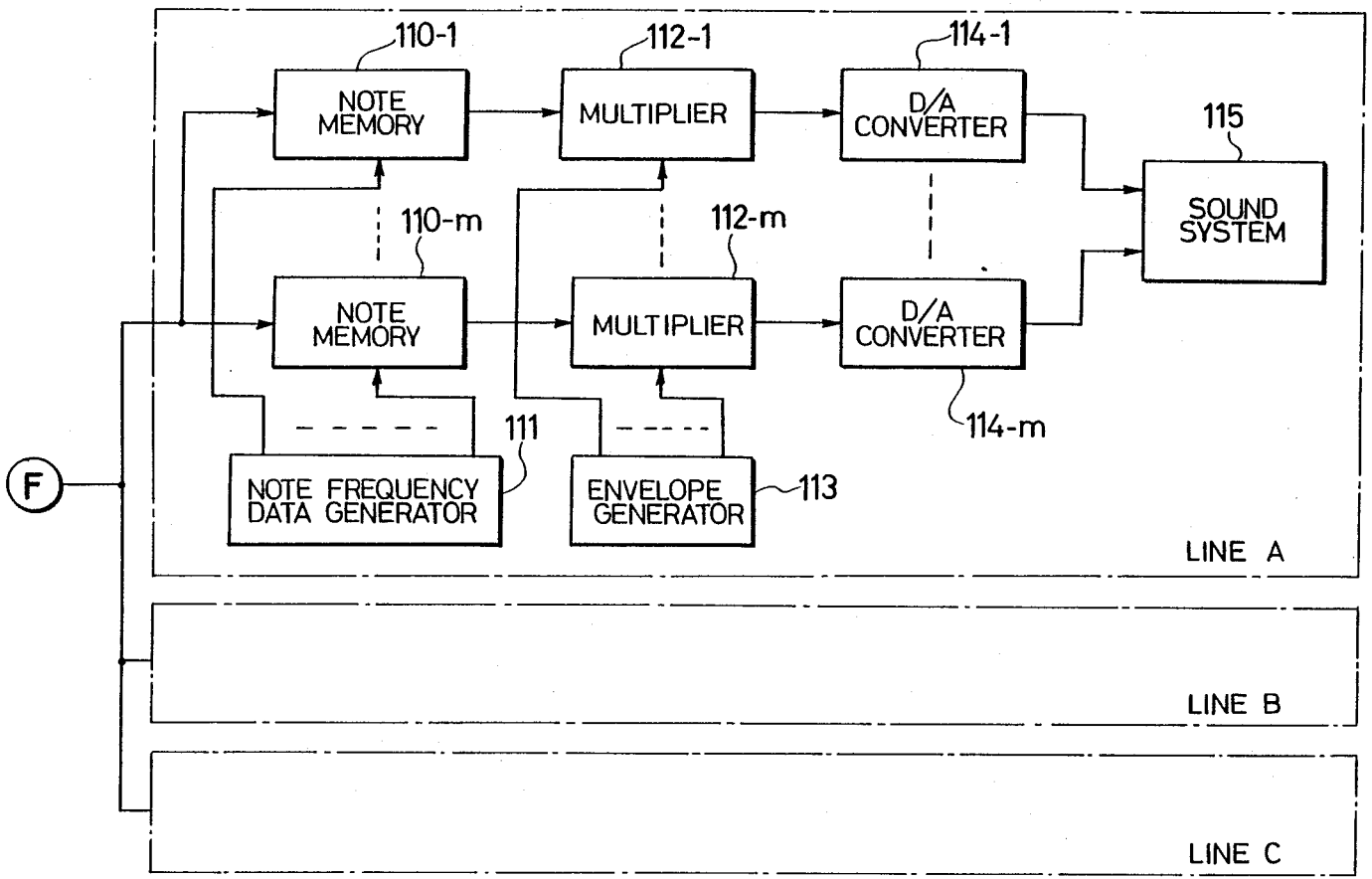
FIG.4B (PRIOR ART)

FIGS. 2A and 2B illustrate in block form the control circuit 103 and the harmonic coefficient generator 105 in an embodiment of the present invention based on the principle set forth in connection with FIGS. 1A to 1C. The other parts of the embodiment are identical with those in FIGS. 4A and 4B, and hence are not shown.

In FIGS. 2A and 2B, the key tablet assignor 102 scans the key tablet switch group 101 to detect the ON/OFF state, touch response, or similar information of the key switches included in the group 101 and holds the information of the respective switches. The key tablet assignor 102 decides how the stored key information is assigned to a line correspondence key information memory 203 and loads the respective key information into the line correspondence key information memory 203 in the control circuit 103. The key information thus stored in the line correspondence key information memory 203 is provided, at predetermined timing, to a number of-depressed-keys detect circuit 204, a depressed key search circuit 206, and a key event detect circuit 208, wherein it is checked. The number of depressed keys detect circuit 204 checks depressed keys in the lines A and B and counts them. In order to determine the operation cycle of the system according to the count values, either one of clocks of rates 1 and $\frac{1}{2}$ is selected by a rate selector 205. The output RS11 from the rate selector 205 means the operation cycle and is applied to the depressed key search circuit 206. The depressed key search circuit 206 includes a counter, which is initialized at the beginning of the output RS11 and checks the key information about the lines A and B on the basis of the key information sent from the line correspondence key information memory 203. When the key thus checked is in the depressed state (a request to use a note memory), the counter is incremented by one after the waveform operation time T. When the checked key is not in the depressed state, the counter is incremented by one with another high-speed clock. In this way, the depressed key search circuit 204 brings about a counting state in which the waveform operation is skipped over for an undepressed key. This counting state is applied, as a process channel signal $\alpha$, to a data selector 209.

The key event detect circuit 208 detects a depressed key by comparing key information of the lines A, B and C from the line correspondence key information memory 203 and key information from an old key memory circuit 207 which stores key information corresponding to the lines. The key event detect circuit 208 applies to the data selector 209 and another data selector 210 an event channel signal which indicates the line and the note memory in which the key event has occurred. Moreover, the key event detect circuit 208 provides to the data selector 209 and an event distinction circuit 211 an event signal 2 regardless of the line in which the key event has occurred. When supplied with the key event signal 2, the data selector 209 selects an event channel signal corresponding to the process channel signal $\alpha$ and applies it to a latch circuit 213. The key event detect circuit 208 further produces an event signal 1, corresponding to a key event for a temporally-varying waveform in each of the lines A and B. The event signal 1 is provided to the data selector 210 and the event distinction circuit 211. When supplied with the event signal 1, the data selector 210 selects the event channel signal corresponding to a process channel signal $\beta$ which sequentially indicates the positions of the note memories in the lines A and B. The event channel signal thus selected is applied to a latch circuit 214, from which it is supplied to an operating section (1) 218 in synchronism with its operation timing. Based on the event channel signal, the operating section (I) 218 calculates an envelope in the channel specified by the event channel signal, producing data for use in an operating section (II) 217. The operating section (II) 217 is supplied with the event channel signal from the latch circuit 213 in synchronism with the operation timing of the former and calculates a formant filter characteristic in the corresponding channel through utilization of the envelope data available from the operating section (I) 218. The even channel signal from the latch circuit 213 is applied via a latch circuit 212 to an operating section (III) 215 in synchronism with the operation timing thereof. Based on this event channel signal, the operating section (III) 215 computes the harmonic coefficient Cq in the corresponding channel, using the formant filter characteristic which is sent from the operating section (II) 217 via a gate circuit 216. The harmonic coefficient Cq thus obtained is provided to the sine wave function table 104 and the waveform operating section formed by the multiplier 106 and the associated elements in FIGS. 4A and 4B.

When the event distinction circuit 211 detects, on the bases of the event signals 1 and 2 from the key event detect circuit 208, that the current key event is in the line C, the event distinction circuit 211 applies an inhibit signal to the gate circuit 216 to disable it for preventing the output data, from the operation section (II) 217, from being incorporated into data for the operation in the operating section (III) 215.

In the old key memory circuit 207 there is prestored checked key information via the key event detect circuit 208 so that once a key event is detected, no key event will be detected during the previously detected key depression. Furthermore, even if a tone tablet for the line C is changed, the waveform being operated will not be changed to a new one since no operation is performed for the line C at all times; and so that the old key memory circuit 207 is cleared by a tablet event so as to create a key event.

As described above, key information assigned to each line on the basis of key information of the key assignor is checked and the method of operation is changed for each line according to the event detected.

Figure 3A:
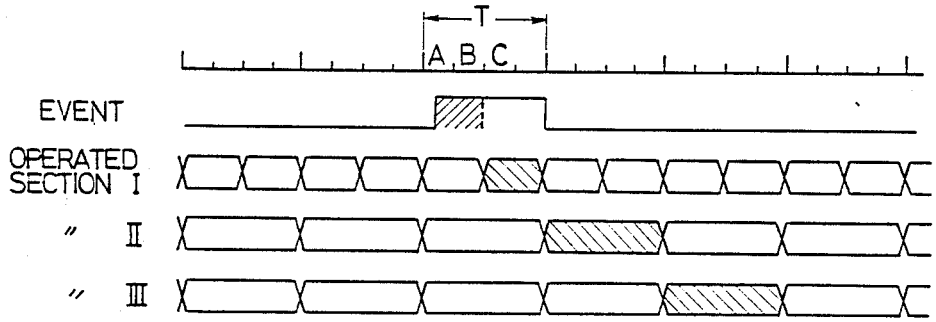
FIGS. 3A through 3C are diagrams for explaining the operation of the embodiment of the present invention.
Figure 3B:
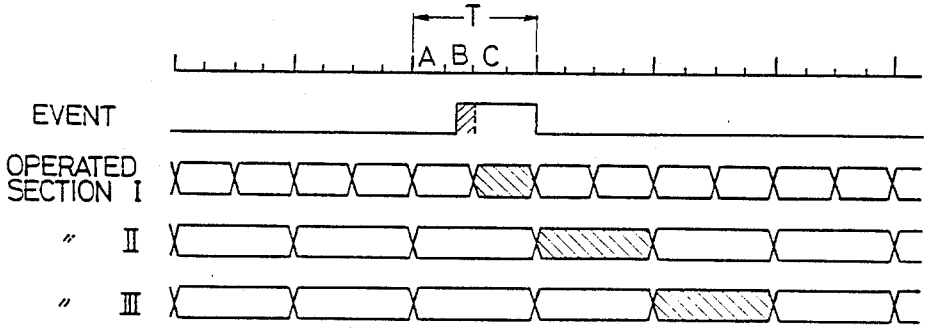
Figure 3C:
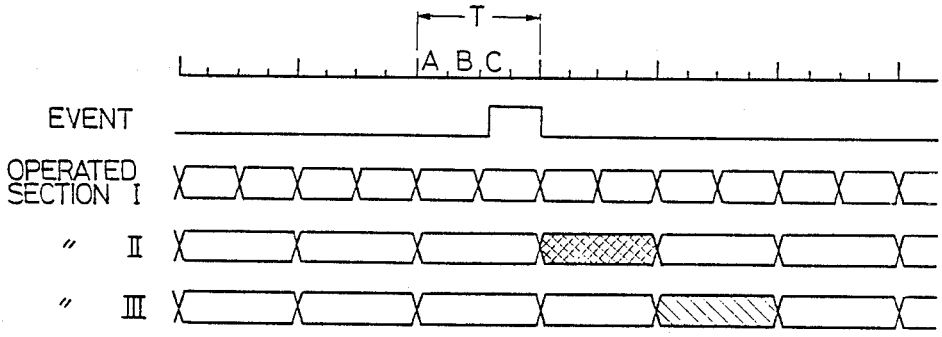

FIGS. 3A through 3C are diagrams for explaining the operation of the embodiment depicted in FIGS. 2A and 2B. In FIGS. 3A to 3C there are indicated by hatching the positions of event processing operations by the respective operating sections in response to the depression of keys, i.e. key events.

Now, a description will be given of the respective operating sections. The following description is intended as being merely illustrative and not as limiting the invention specifically thereto.

The operating section (1) calculates and stores an envelope waveform based on the depression of all keys included in the lines A and B, irrespective of the number of keys being depressed.

The operating section (II) calculates the slope of the formant filter characteristic from the envelope waveform obtained with the operating section (I).

The operating section (III) obtains the scaled temporally-varying harmonic coefficient Cq by calculating a harmonic coefficient and the formant filter characteristic data obtained with the operating section (II) and provides the harmonic coefficient Cq to the waveform operating section.

FIGS. 3A and 3B show how the operating sections (I) 218 to (III) 215 are used for processing a key depression event in which the key information of the line correspondence key information memory for the lines A and B for a temporally-varying waveform is altered from the OFF to the ON state FIG. 3C shows the case where a key depression event has occurred in the line C for a waveform which does not vary with time. In this case, no event processing is performed for the operating section (I) 218 in which no operation is needed for the key depression event in the line C, but event processing is performed for only the operating sections (II) 217 and (III) 215. However, since the formant filter characteristic obtained in the operating section (II) 217 is not needed for the operation in the operating section (III) 215, the formant filter characteristic data is not utilized as data for obtaining the harmonic coefficient Cq in the operating section (III) 215. The cross hatched portion indicates the event processing of the operating section (II) 217.

As described above, according to the present invention, the operation cycle is changed in accordance with the number of keys being depressed simultaneously, thereby eliminating a feeling of discontinuity which is created when the number of concurrently depressed keys decreases.

It will be apparent that many modifications and variations may be effected without departing from the scope of the novel concepts of the present invention.

What is claimed is:

1. An electronic musical instrument which repetitively reads out a desired musical waveform from a tone generator at a rate corresponding to the note of a key being depressed, comprising:

a plurality of keys;

assignor means for scanning said plurality of keys and assigning key information of keys being depressed and released, as a smaller number of pieces of information than the number of said plurality of keys, to said assignor means itself;

a plurality of tone generator series made up of a first series of tone generators for generating tones of temporally-varying waveforms and a second series of tone generators for generating tones of non-temporally-varying waveforms;

computing means for obtaining a desired synthesized waveform by computation to produce said desired musical waveforms;

transfer means for transferring said synthesized waveform to one of said tone generators of one of said plurality of tone generator series; and control means which, in order to generate tones of temporally-varying waveforms from said first series of tone generators, repetitively conducts at a cyclic rate an operation of computation for obtaining said synthesized waveform by said computing means and transfer for transferring said computed synthesized waveform by said transfer means, in accordance with said key information assigned to said assignor means;

wherein said control means includes:

key information memories each corresponding to one of said plurality of tone generator series and having storage areas corresponding to said tone generators of each tone generator series;

means whereby, in association with said key information assigned to said assignor means, information about the usage of each tone generator of each tone generator series is stored as second key information in the corresponding key information memory;

detect means for counting the number of tone generators being used in said first series by reading out said second key information from said key information memories;

cycle alteration means for changing said cycle rate in accordance with said number of tone generators being used, counted by said detect means; and scanning means whereby said second key information about the usage of said tone generators of said first series, read out of the corresponding key information memory is scanned for performing said operation of computation and transfer at the rate changed by said cycle alteration means.

2. The electronic musical instrument of claim 1 wherein said cycle alteration means is means responsive to a signal from said detect means to select one of a plurality of rate signals as said cyclic rate for cyclically controlling said computation and transfer operation.

3. The electronic musical instrument of claim 1 wherein said scanning means includes means which scans said second key information read out of said key information memories to distinguish between tone generators being used and those not being used and skips said operation of computation and transfer over said tone generators not being used.

4. An electronic musical instrument comprising:

a plurality of keys;

tone generator means, associated with said plurality of keys, for generating a plurality of synthesized waveforms determined by the combination and number of said plurality of keys being depressed;

a plurality of note memories capable of storing said plurlaity of synthesized waveforms;

operation cycle means, associated with said plurlaity of note memories, for sequentially addressing each of said plurality of note memories over a period of time;

detector means, associated with said plurality of keys, for detecting the number of said plurality of keys being depressed;

rate selector means, associated with said operation cycle means and said detector means, for reducing said period of time when said number of said plurality of keys being depressed is reduced; and generator means, associated with said plurality of note memories, for producing a sound;

whereby when heard the feeling of discontinuity in the temporal variation of the resulting musical waveform is reduced.

5. An electronic musical instrument as in claim 4 wherein:

said period of time is reduced in direct proportion to a reduction in said number of said plurality of keys being depressed.

* * * * *